US005518585A

United States Patent [19]

Huth et al.

[11] Patent Number: 5,518,585

[45] Date of Patent: May 21, 1996

[54] NEUTRAL SIZING AGENT FOR BASE PAPER STUFF WITH THE USE OF CATIONIC PLASTICS DISPERSIONS

[75] Inventors: Hans U. Huth, Egelsbach; Walter Kamutzki, Dieburg, both of Germany

[73] Assignee: Hoechst Aktiengesellschaft, Germany

[21] Appl. No.: 393,457

[22] Filed: Feb. 23, 1995

Related U.S. Application Data

[63] Continuation of Ser. No. 827,446, Jan. 29, 1992, abandoned, which is a continuation of Ser. No. 575,941, Aug. 31, 1990, abandoned.

[30] Foreign Application Priority Data

Sep. 2, 1989 [DE] Germany ..... 39 29 226.6

[51] Int. Cl.[6] ..... D21H 17/34

[52] U.S. Cl. ..... 162/168.2; 162/168.3; 162/168.1

[58] Field of Search ..... 162/168.1, 168.2, 162/168.3, 164.6, 169, 175, 164.4

[56] References Cited

U.S. PATENT DOCUMENTS

| | | | |
|---|---|---|---|
| 4,178,205 | 12/1979 | Wessling et al. | 162/168.1 |
| 4,189,345 | 2/1980 | Foster et al. | 162/168.1 |
| 4,381,367 | 4/1983 | Von Bonin et al. | 162/168.2 |
| 4,659,431 | 4/1987 | Probst et al. | 162/168.2 |

*Primary Examiner*—Peter Chin
*Attorney, Agent, or Firm*—Bierman and Muserlian

[57] ABSTRACT

Neutral sizing of base paper pulp in a conventional aqueous suspension at a neutral pH for the production of sized, acid-free base paper by internal sizing with the use of aqueous cationic copolymer dispersions having a minimum cation activity of 20 μmol/g of solids, more than half of the cationic charge being located on the surface of the dispersion copolymer particles, in combination with polymeric retention aids, the weight ratio of the polymeric retention aid to the cationic dispersion copolymer preferably being 0.3:1 to 0.005:1, in a quantity of up to 2% by weight of cationic dispersion copolymer, relative to the dry weight of the raw cellulose fibers. The internal sizing is effected by intensive mixing of the neutral sizing agent components with the raw cellulose fiber suspension, with the proviso that either the polymeric retention aid is added first and the cationic plastics dispersion is metered in afterwards or the two agents are metered separately at the same time into the cellulose fiber suspension, if desired with the additional use of inert fillers, pigments, dyes and conventional auxiliaries, and by subsequent isolation of the acid-free base paper in the conventional manner, if appropriate as base paper webs or base paper boards, and drying of the internally sized neutral base paper. In the combination according to the invention with the polymeric retention aid, the cationic plastics dispersion surprisingly shows a synergistic increase of its internal sizing effect in the neutral pH range.

5 Claims, No Drawings

NEUTRAL SIZING AGENT FOR BASE PAPER STUFF WITH THE USE OF CATIONIC PLASTICS DISPERSIONS

PRIOR APPLICATIONS

This application is a continuation of U.S. patent application Ser. No. 827,446 filed Jan. 29, 1992 which is a continuation of U.S. patent application Ser. No. 575,941 filed Aug. 31, 1990, both now abandoned.

The invention relates to the use of aqueous cationic plastics dispersions in combination with polymeric retention aids for the internal sizing of base paper stuff at a neutral pH.

An important process stage in the manufacture of paper is, as is known, the sizing of the cellulose fibers during base paper production. In the initial paper production from the cellulose raw material, it serves, inter alia, the purpose of making the paper more easily writable and/or printable by appropriately rendering the cellulose fibers hydrophobic. As the paper sizing agent, resin sizers based on colophony are normally used for this purpose, which are precipitated, for example by means of aluminum salts, from the aqueous phase of the paper pulp, thus being absorbed on the cellulose fibers. Subsequently, after the addition of retention agents and flocculating agents and also, if appropriate, further auxiliaries and/or fillers to the paper pulp, the cellulose fibers, which have been rendered hydrophobic during the precipitation of the resin size, can easily be removed from the aqueous phase and recovered in the form of base paper webs.

As is known, however, this procedure leads to considerable effluent problems and can cause severe corrosion on the paper machines. Due to the acidic constituents contained in the precipitated paper stuff, it also leads to unsatisfactory storage stabilities of the finished paper.

The endeavors of the papermakers to add less expensive but acid-sensitive calcium carbonate as a filler material in place of kaolin to the paper coating compounds and, moreover, also to be able to use scrap paper and waste paper, and the lower storage stability of paper, the base sizing of which was carried out at a pH in the acidic range, caused an increasing demand for so-called neutral sizing agents which can deploy their effect, as far as possible, at a pH of 7. With respect to further process rationalization, it also became necessary to be able to adapt the degree of sizing directly to the particular requirement merely by varying the quantity of neutral sizing agent used.

Therefore, cationic polymer solutions or polymer dispersions have already been employed for the production of sized paper at a neutral pH, since, due to the product-specific substantivity of polymeric cationic molecules, voluntary absorption of the latter on the cellulose fibers can already take place without previous destabilization of their solution or dispersion.

For example, German Auslegeschrift 1,053,783 has disclosed cationic copolymers which can be obtained by polymerization initiated by free radicals in bulk or in solution or in aqueous dispersion. They contain monomer units of esters or amides of acrylic or methacrylic acid, which contain, in the ester or amide radical of the monomer units, located in the side chain, at least one quaternary ammonium compound which is bound via an alkylene group to the hetero atom of the ester grouping or amide grouping. These copolymers can also contain, as comonomer constituents, monomer units from the group comprising vinyl acetate, vinyl formate, vinylidene chloride, styrene, isobutylene, butadiene and butyl acrylate, and are used for the production of compression-molding compounds, films, fibers, adhesives, surface coatings, textile auxiliaries and the like. It has been found, however, that virtually all the cationic copolymer dispersions mentioned in German Auslegeschrift 1,053,783 are unsuitable for use as a paper sizing agent and/or that sized paper produced with these shows unsatisfactory properties.

German Patent 1,546,236 has disclosed cationic copolymer dispersions which can be used for the production of sized papers. The copolymers of these products contain 20 to 60% by weight of styrene and/or acrylonitrile, 20 to 60% by weight of (meth)acrylic acid esters and 5 to 50% by weight of cationic monomer units composed of ethylenically unsaturated compounds and a quaternary nitrogen atom. To achieve useful results with these copolymers, however, those containing at least 20% by weight of cationic monomer units are required, which, in view of the limited availability and high production costs of the required cationic starting monomers, militates against wide use of the copolymers thereof.

European Patent 119,109 has disclosed cationic copolymer latices which are said to be suitable as paper sizing agents. The copolymers of these products are composed predominantly of vinyl esters, (meth)acrylic acid esters, vinylaromatics and 1 to 20% by weight of monomer units which are capable of taking up a cationic charge and some of which contain nitrogen, preferably based on (meth)acrylamides, some of which are quaternized. They also contain nonionic or cationic emulsifiers. With a view to a potential use of these products in papermaking, however, no test results have so far become known.

All the cationic plastics dispersions hitherto recommended as paper sizing agents as substitutes for the acidic resin sizes have obvious considerable disadvantages which act against their use as paper sizing agents in practice. For hard sizing, they either require an unduly high proportion of cationic monomer units, which is too serious a cost factor, or they demand the use of unduly large quantities of copolymer, for example up to 5% by weight, relative to the cellulose content in the paper. Moreover the products do not leave sufficient scope to the papermaker for having an influence, using the same sizing agent, on the degree of sizing of the paper to the extent needed.

It was thus the object of the present invention to provide a paper sizing agent for the internal sizing of paper at a neutral pH, which, in particular, makes inexpensive sizing possible, is easy to apply and can lead to hard sizing even with small quantities applied. Moreover, it should enable the user, by simple and slight alterations, such as, for example, variations in concentration, also to obtain paper at low degrees of sizing and, moreover, at the same time sufficiently to vary the dry strength of the sized base paper.

It has now been found, surprisingly, that the abovementioned difficulties can be overcome and water-dilutable sizing agents which can advantageously be used for internal sizing of paper at a neutral pH can be obtained by employing finely particulate aqueous cationic copolymer dispersions having specific property features according to the invention in combination with polymeric retention aids.

The invention therefore relates to the use of aqueous cationic plastics dispersions as a neutral sizing agent for the internal sizing of base paper stuff in a conventional aqueous suspension at a neutral pH for the production of acid-free base paper, which comprises intensively mixing aqueous cationic copolymer dispersions having a minimum cation activity of 20 μmol/g of solids, more than half of the cationic charge being located on the surface of the dispersion copolymer particles, the minimum film-forming temperature (MFT) of the dispersion being below 50° C., the glass temperature $T_G$ of the copolymer being below 70° C. and above 0° C. and the mean particle diameter of the cationic dispersion copolymer particles being below 0.5 μm, with the raw cellulose fiber suspension at a pH in the range from 6.5 to 7.5 in a quantity of up to 2% by weight of cationic dispersion copolymer, relative to the dry weight of the raw cellulose fibers, in combination with polymeric retention aids, the weight ratio of the polymeric retention aid to the cationic dispersion copolymer being preferably 0.3:1 to 0.005:1, with the proviso that either the polymeric retention aid is added first and the cationic plastics dispersion is metered in afterwards or the two agents are metered separately at the same time into the aqueous cellulose fiber suspension with intensive mixing, if desired with the additional use of inert fillers, pigments, dyes and conventional auxiliaries, inter alia of fillers based on calcium carbonate, and then isolating the acid-free base paper from the aqueous suspension in the conventional manner, preferably in the form of base paper webs or base paper board, and drying it.

The invention also relates to a process for producing sized acid-free base paper from raw cellulose fibers in a conventional aqueous suspension with the use of aqueous cationic plastics dispersions and polymeric retention aids as the neutral sizing agent at a pH from 6.5 to 7.5, which comprises intensively mixing the sizing agent, as specified in the preceding paragraph, preferably at normal temperature, with the aqueous cellulose fiber suspension, if desired with the additional use of inert fillers, pigments, dyes and conventional auxiliaries, inter alia of fillers based on calcium carbonate, and isolating the sized acid-free base paper in the conventional manner and drying it.

Furthermore, the invention relates to acid-free, internally sized base paper in the form of two-dimensional webs, boards or moldings or in the form of flocks or nonwovens, produced by the process indicated above, if desired with the additional use of inert fillers, dyes and conventional auxiliaries, if appropriate of fillers based on calcium carbonate.

As the polymeric retention aids, the products known as polymeric retention agents and drainage accelerators are used in the usual applied quantities, if appropriate in the form of their aqueous solutions or aqueous dilutions. These are admixed either as such simultaneously with the aqueous cationic copolymer dispersions used according to the invention to the aqueous cellulose fiber suspension in the neutral pH range, or the retention aid is added first and the cationic copolymer dispersion is admixed afterwards, the latter variant being preferred.

In this combined use, according to the invention, of polymeric retention aids and cationic copolymer dispersions according to the invention, the result is, surprisingly, an evidently synergistic increase of efficacy in paper sizing. This allows, inter alia, a sufficiently effective use of very inexpensive applied quantities of cationic monomer units in the cationic dispersion copolymers coupled simultaneously with a widened concentration-dependent grading of activity.

As is known, retention agents and drainage accelerators in conventional use serve the purpose of increasing the retention of fibers, fines and fillers on the Fourdrinier wire. Moreover, certain product types can effect an increase in the drainage rate on the wire and in the wet presses as well as more rapid drying of the paper web in the dry end, which can be exploited for increasing production or saving energy. The activity of the higher-molecular to high-molecular products is based, according to experience, on a reduction of the negative zeta-potential of the paper stuff suspension and/or on bridging between paper stuff particles by the polymers, whereby in both cases a microflocculation of the paper stuff suspension is effected. However, an effective paper sizing effect cannot be achieved solely by using the polymeric retention aids. The evidently synergistic activity increase in paper sizing with cationic plastics dispersions due to the combined use of polymeric retention aids and cationic copolymer dispersions according to the invention was therefore all the more surprising.

The polymeric retention aids which can be used according to the invention are in particular: polyamines, preferably higher-molecular polyalkylene polyamines, in particular polyethyleneimine, or reaction products such as can be obtained by crosslinking oligoamines with dichloroethane, epichlorohydrin or reaction products of epichlorohydrin and polyether-diols, polyamidoamines, preferably polyamideamines such as can be obtained by reacting adipic acid with diethylenetriamine or similar polyamines and crosslinking with the abovementioned crosslinking agents, or reaction products based on ethyleneimine/adipic acid/polyamine/epichlorohydrin, polyacrylamides, preferably high-molecular polyacrylamides, such as, for example, anionically modified acrylamide/acrylic acid copolymers, cationically modified copolymers of acrylamide with aminoacrylic and aminomethacrylic acid esters having tertiary and quaternary amine functional groups, and cationic products formed by a MANNICH reaction of polyacrylamide homopolymers, polysalts, for example polymers or copolymers of diallyldimethylammonium chloride (poly-DADMAC homopolymers or copolymers), preferably poly-DADMAC copolymers, having molecular weights in the range from $10^4$ to $10^6$, particularly preferably $10^5$ to $10^6$, in particular copolymers with vinyl acetate and/or acrylamide and/or N-methylolacrylamide, and homopolymeric poly-DADMAC having molecular weights of preferably at least 10,000 is also particularly preferred, cationic starch, guar derivatives and cationic polyvinyl alcohol. Cationic polymeric retention aids are preferred.

According to the invention, preferably 0.05 to 0.2% by weight, in particular 0.05 to 0.1% by weight, relative to the dry weight of the cellulose, of retention aids are added in combination with a cationic copolymer dispersion to the cellulose fiber suspension, with the proviso that either the retention aid is added as such simultaneously with the cationic copolymer dispersion or that the retention aid is added first and the cationic copolymer dispersion is added afterwards.

Since the polymeric retention aids used according to the invention can in general form colloidal aqueous solutions, they can advantageously and preferably be admixed in the form of colloidal aqueous solutions to the cellulose fiber suspension.

The aqueous cationic plastics dispersions to be used according to the invention for the internal sizing of base paper in the neutral pH range, preferably at a pH from 6.5 to 7.5, can in principle be any aqueous cationically charged plastics dispersions or polymer dispersions, but preferably those having a mean particle diameter of from 0.05 to 0.5 μm and a minimum cation activity of 20 to 200 μmol/g of solids, more than half of the cationic charge being located on the surface of the dispersion copolymer particles, in particular those in which 60 to 90% of the cationic charge is located on the surface of the dispersion copolymer particles. The molecular weight of the dispersion copolymers is not critical and can preferably range from 10,000 up to several million.

Lower and higher molecular weights are also possible. In general, they are adapted to the requirements and objectives. The applied quantity of the cationic plastics dispersions in combination with the abovementioned retention aids is preferably 0.1 to 2% by weight, in particular 0.5 to 1% by weight, of dispersion copolymer solids, relative to the dry weight of the cellulose fiber stuff or base paper stuff employed for sizing in the cellulose fiber suspension.

With particular preference, the retention aid and aqueous cationic plastics dispersion are used in a weight ratio from 0.2:1 to 0.01:1, relative to the copolymer solids content of the cationic dispersion.

Those aqueous cationic copolymeric plastics dispersions are also used with particular preference which are based on ethylenically unsaturated monomers and whose dispersion copolymer particles, in % by weight relative to the total quantity of monomer units in the copolymer, are built up from a) 60 to 95% by weight of ethylenically unsaturated monomers from the group comprising vinyl esters of ($C_1$-$C_{18}$)-monocarboxylic acids, preferably vinyl acetate, vinyl propionate, vinyl versatate, vinyl laurate and vinyl stearate, (meth)acrylates of ($C_1$-$C_{22}$)-alcohols, preferably methyl methacrylate, butyl methacrylate, octyl methacrylate, ethyl acrylate, isobutyl acrylate and 2-ethylhexyl acrylate, vinyl aromatics, preferably styrene and vinyl-toluene, vinyl chloride, ethylene, (meth)acrylonitrile and diesters of maleic acid and/or fumaric acid with ($C_1$-$C_{18}$)-alcohols;

In a particularly preferred variant, component a) is composed, relative to component a), of 50 to 70% by weight of hydrophobic monomers from the group comprising (meth-)acrylonitrile, vinylaromatics, preferably styrene and vinyl-toluene, and 25 to 45% by weight of esters of (meth)acrylic acid, preferably butyl acrylate, octyl acrylate, butyl methacrylate and octyl methacrylate;

A further feature essential to the invention is that, moreover, the aqueous cationic copolymeric plastics dispersions used according to the invention have a minimum film-forming temperature (MFT) in the range from 0° to 50° C. and the glass temperature $T_G$ of the cationic dispersion copolymer is between 10° and 65° C., preferably between 20° and 50° C.;

b) 2 to 20% by weight, preferably 3 to 10 and in particular 3 to 7% by weight, of ethylenically unsaturated, salt-forming water-soluble monomers having alkylammonium, alkylsulfonium or alkylphosphonium groups, preferably alkylammonium groups, in particular from the group comprising trimethylammoniumethyl (meth)acrylate chloride, β-acetamido-diethyl-aminoethyl (meth)acrylate chloride, (meth-)acrylamidopropyltrimethylammoniumchloride, (meth-)acrylamidoethyltrimethylammoniumbromide, trimethylammoniumneopentyl (meth)acrylate chloride, diallyldimethylammonium chloride and diallyl-butylmethylammonium bromide;

c) 2 to 20% by weight, preferably 3 to 15 and in particular 3 to 8% by weight, of ethylenically unsaturated monomers having at least one functional radical $$-C(=O)-NR^1R^2,$$

in which the substituents $R^1$ and $R^2$ can be identical or different and at least one is a ($C_1$-$C_6$)-alkyl-etherified or unetherified ($C_1$-$C_6$)-alkylol group, preferably from the group comprising N-methylol(meth)acrylamide, dimethylol(meth)acrylamide, N-methoxymethyl(meth)acrylamide, N-butoxymethyl(meth)acrylamide, N-isobutoxymethyl-(meth)acrylamide and N-(3-hydroxy-2,2-dimethylpropyl)-(meth)acrylamide, N-methylolacrylamide, N-methoxymethylmethacrylamide and N-butoxymethylmethacrylamide being particularly preferred, d) 0 to 5% by weight of further ethylenically unsaturated monomers, different from a) to c), having functional radicals from the group comprising $$-COOH, \quad -C(=O)-NR^1R^2$$

in which $R^1$ and $R^2$ can be identical or different and are H, ($C_1$-$C_4$)-alkyl, ($C_5$-$C_7$)-cycloalkyl or ($C_6$-$C_{18}$)-aralkyl, —OH, —$Si(OR)_3$, R being ($C_1$-$C_4$)-alkyl or ($C_1$-$C_4$)-alkyl-etherified ($C_1$-$C_4$)-hydroxyalkyl or acetyl, it being possible for the three substituents R to be identical or different, $$-O-C(=O)-NR^3R^4,$$

in which $R^3$ and $R^4$ can be identical or different and are ($C_1$-$C_{18}$)-alkyl, ($C_5$-$C_7$)-cycloalkyl or ($C_6$-$C_{12}$)-aryl or -aralkyl, $$-N(R^5)-C(=O)-NR^6R^7,$$

in which $R^5$, $R^6$ and $R^7$ can be identical or different and are H, ($C_1$-$C_{18}$)-alkyl, ($C_5$-$C_7$)-cycloalkyl or ($C_6$-$C_{12}$)-aryl or -aralkyl, preferably monomers from the group comprising ethylenically unsaturated carboxylic acids, in particular acrylic acid, methacrylic acid, itaconic acid, maleic acid and fumaric acid as well as the half-esters of these dibasic carboxylic acids with straight-chain or branched ($C_1$-$C_8$)-alcohols, ethylenically unsaturated amides, in particular acrylamide, methacrylamide, N-methylacrylamide, N-butylmethacrylamide, N-tert.-butylmethacrylamide, N-cyclohexylmethacrylamide, N-benzylmethacrylamide, diacetoneacrylamide and methylacrylamidoglycolate methyl ether, ethylenically unsaturated hydroxyalkyl esters, in particular hydroxyethyl acrylate, hydroxypropyl acrylate, hydroxyethyl methacrylate, hydroxypropyl methacrylate, polyglycol ethers of acrylic or methacrylic acid with 2 to 50 ethylene oxide units and polypropylene glycol ethers of acrylic or methacrylic acid with 2 to 50 propylene oxide units, it being possible for the end group of the polyalkylene glycol ether radicals to be etherified with an alkyl or aryl radical, ethylenically unsaturated silanes, in particular vinyltrimethoxysilane, vinyltriethoxysilane, methacryloxypropyltrimethoxysilane, methacryloxypropyltris-(methoxyethoxy)-silane, vinyl-tris-(methoxyethoxy)-silane and vinyltriacetoxysilane, ethylenically unsaturated urethanes, in particular N-methylcarbamidoethyl methacrylate, N-butylcarbamidoisopropyl methacrylate, N-octadecylcarbamidoethyl acrylate, N-phenylcarbamidoethyl methacrylate and N-cyclohexylcarbamidoethyl acrylate, ethylenically unsaturated ureas, in particular 2-methacryloylethylurea, 2-octylmethacryloylethylurea and 2-phenylmethacryloylethylurea, ethylenically unsaturated sulfonic acids or sulfonic acid derivatives, in particular ethylenesulfonic acid, (3-sulfopropyl)-methacrylates or acrylamidomethylpropanesulfonic acid or salts thereof, preferably alkali metal salts or ammonium salts, and ethylenically unsaturated phosphonic acids, in particular vinylphosphonic acid or acrylamidomethylpropanephosphonic acid or alkali metal salts or ammonium salts thereof, e) 0 to 5% by weight of ethylenically unsaturated fluorine-containing monomers, preferably acrylates or methacrylates of partially fluorinated or perfluorinated ($C_1$-$C_8$)-alkanols or partially fluorinated or perfluorinated ($C_2$-$C_{18}$)-alkylenes, in particular from the group comprising 2,2,3,4,4,4-hexafluorobutyl methacrylate, 2,2,3,3-tetrafluoropropyl methacrylate or perfluorohexylethylene, f) 0 to 5% by weight of ethylenically unsaturated carbonyl compounds, preferably from the group comprising vinyl methyl ketone, acrolein, crotonaldehyde, allyl acetoacetate and acetoacetoxyethyl (meth)acrylate, g) 0 to 5% by weight of ethylenically unsaturated monomers capable of crosslinking, preferably from the group comprising ethylenically polyunsaturated or polyfunctional monomers, in particular divinylbenzene, diallyl phthalate and butanediol diacrylate, triethylene glycol dimethacrylate, allyl methacrylate, bisphenol A diethylene glycol dimethacrylate, triallyl cyanurate and methylene-bis-methacrylamide, and the dispersions also containing h) 0.1 to 10% by weight, preferably 0.2 to 6% by weight, relative to the total quantity of all monomer units in the copolymer, of emulsifiers and/or, if necessary, protective colloids, preferably from the group comprising the cationic, amphoteric and in particular nonionic surfactants and/or protective colloids.

Those cationic dispersion copolymers are particularly preferred which contain, as the monomer units, styrene/butyl acrylate, trialkylammoniumalkyl-(meth)acrylate chloride and N-methylol-(meth)acrylamide.

The emulsifiers employed in the preparation of the aqueous cationic copolymer dispersions to be used according to the invention, preferably in the emulsion polymerization of the comonomers, can be conventional nonionic emulsifiers, in particular nonionic surfactants, preferably from the group comprising the reaction products of aliphatic, cycloaliphatic, araliphatic, aliphatic-aromatic or aromatic carboxylic acids, alcohols, phenols or amines with epoxides such as, for example, ethylene oxide, and also block copolymers of different epoxides such as, for example, ethylene oxide and propylene oxide.

Examples of further preferred emulsifiers are primary, secondary and tertiary fatty amines in combination with organic or inorganic acids and also surface-active quaternary alkylammonium compounds. Amphoteric surfactants of a zwitter-ionic structure, for example of the betaine type such as alkylamidopropylbetaines, can also be used. Particularly preferred emulsifiers are nonionic surfactants, in particular alkyl polyglycol ethers and alkylaryl polyglycol ethers having 15 to 50 ethylene oxide units. Said emulsifiers can be employed either individually or in combination with one another or altogether. The quantity of the emulsifiers to be used depends on the desired dispersion properties and is preferably 0.1 to 10% by weight, in particular 0.2 to 6 and particularly preferably 0.3 to 4% by weight, relative to the total quantity of all the monomer units in the copolymer.

The protective colloids used can preferably be those based on high-molecular organic compounds which possess hydroxyl groups, amino groups or ammonium groups and are water-soluble or water-dispersible and at the same time essentially deploy no pronounced surface activity or none at all and possess a pronounced dispersing capacity. Examples of preferred protective colloids are cationic polyelectrolytes, for example polydiallyldimethylammoniumchloride (poly-DADMAC), cellulose ethers, polyvinyl alcohols, polysaccharides (chitosan, starch) and polyvinylpyrrolidones, it being possible for these compounds preferably to be substituted by amino groups or quaternary ammonium groups. The latter groups can be introduced, for example, by substitution by means of cationizing reagents such as, for example, glycidyltrimethylammonium chloride, into the underlying macro-molecules. Cationic polyvinyl alcohols can, for example, also be obtained by saponification of corresponding vinyl acetate copolymers containing amino groups and/or ammonium groups. Particularly preferred protective colloids are cationically modified polysaccharides and cationic polyelectrolytes. The quantities of protective colloid to be used depend on the desired dispersion properties, in particular on the fine size of the dispersion particles. Preferably, quantities of protective colloid of between 0 and 5% by weight, in particular between 0.1 and 2% by weight, relative to the total quantity of monomers, are used in the emulsion polymerization, if necessary.

The cationic plastics dispersions used according to the invention can be prepared by conventional emulsion polymerization by the continuous feed process or pre-emulsion process, preferably at 20° to 100° C., in particular at 50° to 90° C. A part of the monomer mixture can then be prepolymerized in the aqueous liquor in the conventional manner, and the remainder of the monomer mixture can be fed in continuously while maintaining the reaction at the reaction temperature.

The cationic plastics dispersions used according to the invention have a high cation activity of preferably at least 20 to 200 μmol/g of solids, measured at pH 7, it being particularly advantageous when more than half, in particular 60 to 90%, of the cationic charges are located on the surface of the copolymer particles.

A high content of cationic surface charge can be obtained, for example, by adding the cationic, salt-type, ethylenically unsaturated quaternary monomers, preferably alkylammonium compounds, mentioned above under b), during the copolymerization in non-uniform quantities, and preferably larger quantities with the monomer mixture at the start of the copolymerization. The measurement of the cation activity and of the cationic surface charge proportion can be carried out, for example, volumetrically in the known manner (cf. W. Schempp and H. T. Trau, Wochenblatt für Papierfabrikation 19, 1981, pp. 726–732, or J. P. Fischer and K. Löhr in G. D. Parfitt and A. V. Patsis, Organic Coatings: Science and Technology, Vol. 8, pp. 227–249, Marcel Dekker, Inc., New York, April 1986).

The solids content of the cationic plastics dispersions used according to the invention is within the range conventional for dispersions. For use in the paper pulp, the solids content is preferably adjusted to values from 3 to 40% by weight, in particular 5 to 20% by weight, relative to the plastics dispersion. In these preferred solids concentration ranges, the cationic dispersions according to the invention have a low viscosity and evolve virtually no troublesome foam when in use.

In contrast to the polymeric retention aids used according to the invention, which can form colloidal aqueous solutions, the dispersion copolymers which can be isolated from the aqueous cationic plastics dispersions used according to the invention are insoluble in water.

In the preparation of the cationic plastics dispersions by emulsion polymerization, initiated by free radicals, in an aqueous medium, all the systems which are conventional in emulsion polymerization, are preferably water-soluble and initiate free radical chains, and can also be of an anionic nature, can be used for starting the copolymerization. Examples of preferred initiators are 2,2'-azobis-(2-amidinopropane) dihydrochloride, 2,2'-azobis-(N,N'-dimethyleneisobutylamidine) dihydrochloride, 4,4'-azobis-(4-cyanovaleric acid), $H_2O_2$, tert.-butyl hydroperoxide, persulfates such as ammonium persulfate, sodium persulfate and potassium persulfate, redox systems such as $H_2O_2$/ascorbic acid, if appropriate with the addition of small quantities of polyvalent metal salts such as, for example, iron(II) sulfate, as an activator, and also high-energy radiation as well as conventional photoinitiators. Preferably, azo compounds such as 2,2'-azobis(2-amidinopropane) dihydrochloride and 4,4'-azobis(4-cyanovaleric acid) are used.

For controlling the molecular weight in the emulsion polymerization, conventional regulators such as, for example, mercaptans or halogenohydrocarbons can also be used for lowering the molecular weight, or, if desired, up to 5% by weight, relative to the total quantity of monomers, of ethylenically polyunsaturated or polyfunctional compounds capable of crosslinking such as, for example, divinylbenzene, ethylene glycol dimethacrylate, ethylene glycol diacrylate, butanediol dimethacrylate, butanediol diacrylate, triallyl cyanurate, melamine and isocyanatoethyl methacrylate can be used for increasing the molecular weight.

For quality testing and evaluating the paper sizing agents used according to the invention, paper test sheets of the base paper treated with the sizing agent to be tested are prepared in the usual manner (preparation in accordance with data sheet V/8/116 of 26.11.1976 of the Verein Deutscher Zellstoff- und Papier-Chemiker und -Ingenieure [Association of German Pulp and Paper Chemists and Engineers]). Drying of the test sheets is carried out on a steam-heated cylinder drier with a felt cover. For final conditioning, the test sheets are dried for a further 10 minutes at 120° C. in a drying cabinet.

For the sized test sheets thus obtained, the sizing factor f is determined, which can be calculated by the following equation I:

$$f = \frac{\text{Time} \times 100}{\left[\frac{\text{Weight per unit area}}{10}\right]^2 \times 60} \quad \text{(I)}$$

The values of the sizing factor f are rated as follows:

>20 to 20=highly sized paper (hard sizing of the cellulose fibers)

20 to 10=well sized paper 10 to 5=moderately sized paper 5 to 1=poorly sized paper 1 to <1=unsized paper.

The parameter "time" appearing in equation I is the time in seconds required by a test ink (according to DIN 53 126) from first contact up to the first sign of penetration of the paper sample when acting on the paper under constant pressure and without impeding influences. It is determined by means of the sizing degree tester PLG-e (made by Schröder, Weinheim, Germany), which photoelectrically records the reflectivity changing due to the penetration of the ink into the paper, as a function of the time.

The dry and wet breaking strengths [N] is determined in accordance with DIN 53 112, but the watering time is reduced from 24 hours to 1 hour.

The Mullen bursting strength can be determined in accordance with DIN 53 141.

The invention is explained in more detail by the examples which follow.

EXAMPLE 1

A mixture of 7.5 g of nonylphenol polyglycol ether with 30 ethylene oxide units (30 EO), 37.5 g of methacrylamidopropyltrimethylammonium chloride (MAPTAC) (50% by weight, aqueous), 39.0 g of N-methylolacrylamide (48% by weight, aqueous) and 892 g of deionized water is introduced into a 2 liter stirred reactor. After a further addition of 37.5 g of a monomer mixture composed of 37.5 g of styrene, 150 g of methyl methacrylate, 187.5 g of butyl acrylate and 3.75 g of ethylene glycol dimethacrylate, the mixture is heated to 90° C. and the polymerization is started by addition of 2.5 g of a 1% by weight aqueous $Cu(NO_3)_2$ solution and 15 g of 30% by weight aqueous $H_2O_2$. The remainder of the monomer mixture is then added in the course of 2 hours at 85° C. After the end of the addition, 10 g of 30% by weight aqueous $H_2O_2$ and 2.5 g of 1% by weight aqueous $Cu(NO_3)_2$ solution are added, the mixture is allowed to polymerize further for 1 hour at 90° C. and then cooled to room temperature. The conversion of the quantity of monomers employed is virtually quantitative and the resulting cationic copolymer dispersion is obtained free of coagulate. It has a solids content of 30% by weight, relative to the dispersion, and a cation activity of 153 μmol/g of solids, of which 100 μmol represent the external cation activity. The glass temperature ($T_G$) of the copolymer is +20° C. and the minimum film-forming temperature (MFT) of the dispersion is +10° C.

EXAMPLES 2–4

Example 1 is repeated in each case, but with various modifications. Thus, the quantitative proportions of the comonomers are varied and equivalent quantities of 4,4'-azo-bis-( 4-cyanovaleric acid) (AVA) are used as polymerization initiator in place of the $[Cu(NO_3)_2+H_2O_2]$ catalyst, and admixed to the particular monomer mixture. The further polymerization is initiated in all the Examples 2 to 4 as in Example 1.

In Table 1, the quantitative proportions of the comonomers in the cationic copolymer dispersion of Examples 1 to 4 in % by weight, each relative to the cationic copolymer content, the emulsifier content in % by weight, relative to the copolymer content, the solids content of the dispersion in % by weight, relative to the dispersion, the total cation activity of the copolymer in μmol/g of solids at pH 7 and the proportion of the external cation activity in the total cation activity, and the glass temperature $T_G$ of the copolymer, determined by differential thermal analysis (DSC measurement), are indicated in summary.

COMPARISON EXAMPLE 1

Example 1 is repeated with the modification that the quantitative proportions of the comonomers are varied and the methyl methacrylate is entirely omitted. The polymerization initiators used are the same as in Examples 2 to 4. The numerical values are reproduced in Table 1, as a summary. The resulting cationic copolymer dispersion is not according to the invention since, inter alia, it has an unduly high $T_G$ of 73° C. Moreover, the external cation activity is too low.

TABLE 1

| | Cationic copolymer dispersions | | | | | | | | | | | |
|---|---|---|---|---|---|---|---|---|---|---|---|---|
| | Proportion of monomer units in the copolymer and proportion of auxiliaries (% by weight) | | | | | | | Properties of the dispersion | | | | |
| | Methyl methacrylate | Butyl acrylate | Styrene | MAPTAC[1] | N-MAA[2] | | Emulsifier/protective colloid | Solids content (% by weight) | Cation activity μmol/g of solids at pH 7 Total | Cation activity μmol/g of solids at pH 7 External | $T_G$ (°C.) | MFT (°C.) |
| Ex. No. | | | | | | | | | | | | |
| 1 | 36 | 45 | 9 | 4.5 | 4.5 | 0.9 EGDMA[3] | 2 ENP[4] | 30.0 | 153 | 100 | 20 | 10 |
| 2 | | 45.2 | 45.2 | 4.5 | 4.5 | 0.5 DMANPA[5] | 2 ENP[4] | 28.3 | 157 | 110 | 17 | |
| 3 | | 34.1 | 54.5 | 4.5 | 4.5 | 2.3 HFBMA[6] | 2 ENP[4] | 28.8 | 146 | 129 | 31 | |
| 4 | | 36.4 | 54.5 | 4.5 | 4.5 | | 2 ENP[4] | 28.7 | 120 | 107 | 33 | |
| Comp. Ex. No. | | | | | | | | | | | | |
| 1 | | 18.2 | 72.7 | 4.5 | 4.5 | | 2 ENP[4] | 28.8 | 138 | 65 | 73 | |

[1]Methacrylamidopropyltrimethylammonium chloride
[2]N-Methylolacrylamide
[3]Ethylene glycol dimethacrylate
[4]Ethoxylated nonylphenol (with about 30 ethylene oxide units)
[5]Dimethylaminoneopentyl acrylate
[6]Hexafluorobutyl methacrylate

EXAMPLES 5–8

Using the aqueous cationic copolymeric plastics dispersions according to the invention, obtained according to Examples 1–4, base paper test sheets are prepared in each case in the conventional manner according to data sheet V/8/116 of 26.11.1976 by the Verein Deutscher Zellstoff- und Papier-Chemiker und-Ingenieure [Association of German Pulp and Paper Chemists and Engineers], both with the sole use, not according to the invention, of in each case different employed quantities of cationic copolymer dispersion (1% by weight, 2.5% by weight and 5% by weight of cationic copolymer solids (CATCO S), relative to the raw cellulose dry weight) and with the combined use, according to the invention, of the aqueous cationic copolymeric plastics dispersions according to the invention in an employed quantity of in each case 1% by weight of cationic copolymer solids (CATCO S), relative to the raw cellulose dry weight, together with in each case 0.1% by weight of poly-diallyldimethylammoniumchloride (100%) (=poly-DADMAC), relative to the raw cellulose dry weight, the addition of the said agents to the paper pulp to be sized taking place at pH 7. In this procedure, the poly-DADMAC as an aqueous solution is admixed first to the aqueous paper pulp with stirring and the aqueous cationic copolymer dispersion is in each case then metered in with stirring, and the base paper test sheets are obtained and conditioned in the conventional manner. The simultaneous metering-in of both agents (retention aid and aqueous cationic copolymer dispersion) via separate feeds gives also virtually the same advantageous results.

The sizing factor (f), the wet breaking strength [N] and the dry breaking strength [N] are determined on each of the base paper test sheets obtained. The results are reproduced in summary in Table 2.

COMPARISON EXAMPLES 2–4

In a manner analogous to Examples 5–8, the aqueous cationic copolymer dispersion of Comparison Example I, not according to the invention, is also technologically tested for comparison for its sizing effect in aqueous paper pulp at pH 7, both by itself and in combination with poly-DADMAC, and the corresponding characteristic data are determined on the resulting base paper test sheets (Comparison Example 2). The results are reproduced in summary in Table 2. In Comparison Example 3, base paper test sheets are prepared with the sole addition of 0.1% by weight of poly-DADMAC without a cationic copolymer dispersion and, in Comparison Example 4, base paper test sheets are prepared without addition of poly-DADMAC and without addition of cationic copolymer dispersion. The corresponding quality test results are listed in Table 2.

TABLE 2

| Quality testing of base paper test sheets from internal sizing of base paper with cationic copolymer dispersions | | | | | | | |
|---|---|---|---|---|---|---|---|
| | Cationic copolymer | Employed quantity of cationic copolymer (% CATCO) in % by weight and of polydiallyldimethylammonium chloride (% P-DADMAC) in % by weight, each relative to the raw cellulose dry weight, in internal sizing of base paper | | | | | |
| Ex. No. | dispersion from Example No. | 1% CATCO | 2.5% CATCO | 5% CATCO | 1% CATCO + 0.1% P-DADMAC | 0.1% P-DADMAC 0% CATCO | 0% CATCO 0% P-DADMAC |
| | | | | Sizing factor (f) | | | |
| 5 | 1 | 4 | 27 | >40 | >40 | | |
| 6 | 2 | 10 | >40 | >40 | >40 | | |
| 7 | 3 | 16 | >40 | >40 | >40 | | |
| 8 | 4 | 18 | >40 | >40 | >40 | | |
| Comp. Ex. 2 | Comp. Ex. 1 | 0.1 | 0.2 | 10 | 0.4 | | |
| Comp. Ex. 3 | | | | | | 1 | |
| Comp. Ex. 4 | | | | | | | <1 |
| | | | | Wet breaking strength [N] | | | |
| 5 | 1 | 1.3 | 2.3 | 4.7 | 1.3 | | |
| 6 | 2 | 2.7 | 5.1 | 8.3 | 2.7 | | |
| 7 | 3 | 3.0 | 7.0 | 9.9 | 2.9 | | |
| 8 | 4 | 3.2 | 6.8 | 10.9 | 3.6 | | |
| | | | | Wet breaking strength [N] | | | |
| Comp. Ex. 2 | Comp. Ex. 1 | 1.1 | 1.5 | 2.8 | 1.3 | | |
| Comp. Ex. 3 | | | | | | <1 | |
| Comp. Ex. 4 | | | | | | | <1 |
| | | | | Dry breaking strength [N] | | | |
| 5 | 1 | 42 | 40 | 40 | 36 | | |
| 6 | 2 | 48 | 47 | 48 | 44 | | |
| 7 | 3 | 47 | 50 | 50 | 42 | | |
| 8 | 4 | 47 | 48 | 51 | 46 | | |
| Comp. Ex. 2 | Comp. Ex. 1 | 42 | 39 | 42 | 39 | | |
| Comp. Ex. 3 | | | | | | 40 | |
| Comp. Ex. 4 | | | | | | | 41 |

As can be seen from the results in Table 2, an equally good sizing factor (f), namely hard sizing of the cellulose fibers, is obtained, inter alia, with the combination of 1% by weight of cationic dispersion copolymer according to the invention and 0.1% by weight of poly-DADMAC as with 2.5 to 5% by weight of cationic dispersion copolymer according to the invention alone without the poly-DADMAC retention aid. Obviously, a synergistic activity boost manifests itself here in sizing, which is extremely surprising and not derivable from the state of the art. The wet and dry breaking strength values [N] according to the invention are, surprisingly, also markedly more advantageous than those not according to the invention, at comparable sizing factors (f).

We claim:

1. A process for the internal treating of an aqueous suspension of cellulose fiber pulp stuff in a conventional aqueous suspension at a neutral pH for the production of acid-free base paper, which comprises intensively mixing an aqueous cationic copolymer dispersion having a cation activity of 20 to 200 μmol/g of solids, based on ethylenically unsaturated monomers and whose dispersion copolymer particles in % by weight relative to the total quantity of monomer units in the copolymer units in the copolymer, are built up from a) 60 to 95% by weight of ethylenically unsaturated monomers selected from the group consisting of vinyl esters of ($C_1$-$C_{18}$)-monocarboxylic acids, (meth)acrylates of ($C_1$-$C_{22}$)-alcohols, vinylaromatics, vinyl chloride, ethylene, (meth)acrylonitrile and diesters of maleic acid and diesters of fumaric acid with ($C_1$-$C_{18}$)-alcohols, b) 2 to 20% by weight of ethylenically unsaturated, salt-forming water-soluble monomers having alkylammonium, alkylsulfonium or alkylphosphonium groups, c) 2 to 20% by weight of ethylenically unsaturated monomers selected from the group consisting of N-methylol (meth)acrylamide, dimethylol (meth)acrylamide, N-methoxymethyl (meth)acrylamide, N-butoxymethyl (meth)acrylamide, N-isobutoxymethyl (meth)acrylamide, N-(3-hydroxy- 2,2-dimethylpropyl)-(meth)acrylamide, N-methylolacrylamide, N-methoxymethyl-methacrylamide and N-butoxymethyl-methacrylamide, d) 0 to 50% by weight of further ethylenically unsaturated monomers, different from a) to c), having functional radicals selected from the group consisting of $$-COOH,\ -\overset{\overset{\displaystyle O}{\|}}{C}-NR^1R^2$$

$R_1$ and $R_2$ individually being selected from the group consisting of H, ($C_1$-$C_4$)-alkyl, ($C_5$-$C_7$)-cycloalkyl, ($C_6$-$C_{18}$)-aralkyl; —OH; and —$Si(OR)_3$, R being ($C_1$-$C_4$)-alkyl or ($C_1$-$C_4$)-alkoxy ($C_1$-$C_4$)-alkyl or acetyl, the three substituents of R being identical or different;

$$-O-\overset{\overset{\displaystyle O}{\|}}{C}-NR^3R^4$$

$R^3$ and $R^4$ individually being ($C_1$-$C_{18}$)-alkyl, ($C_5$-$C_7$)-cycloalkyl or ($C_6$-$C_{12}$)-aryl or aralkyl;

$$-\overset{\overset{\displaystyle R^5}{|}}{N}-\overset{\overset{\displaystyle O}{\|}}{C}-NR^6R^7$$

$R^5$, $R^6$ and $R^7$ individually being selected from the group consisting of H, ($C_1$-$C_{18}$)-alkyl, ($C_5$-$C_7$)-cycloalkyl, ($C_6$-$C_{12}$)-aryl and aralkyl; sulfonic acid or sulfonic acid radicals phosphonic acid radicals e) 0 to 5% by weight of ethylenically unsaturated fluorine-containing monomers selected from the group consisting of acrylates and methacrylates of partially fluorinated or perfluorinated ($C_1$-$C_8$)-alkanols or partially fluorinated or perfluorinated ($C_2$-$C_{18}$)-alkylenes, f) 0 to 5% by weight of ethylenically unsaturated carbonyl compounds selected from the group consisting of vinyl methyl ketone, acrolein, crotonaldehyde, allyl acetonacetate and acetoacetoxy-ethyl (meth)acrylate, g) 0 to 5% by weight of ethylenically unsaturated monomers capable of cross-linking selected from the group consisting of divinylbenzene, diallyl phthalate, butanediol diacrylate, triethylene glycol dimethacrylate, triallyl cyanurate and methylene-bis-methacrylamide, and the dispersion also contains, h) 0.1 to 10% by weight, relative to the total quantity of all monomer units in the copolymer, of emulsifiers selected from the group consisting of the cationic, amphoteric and non-ionic surfactants, more than half the cationic charge being located on the surface of the dispersion copolymer particles, the minimum film-forming temperature (MFT) of the dispersion being below 50° C., the glass temperature Tg of the copolymer being below 70° and above 0° C. and the mean particle diameter of the cationic dispersion copolymer particles being below 0.5 μm, with the raw cellulose fiber suspension at a pH in the range from 6.5 to 7.5 in a quantity of up to 2% by weight of cationic dispersion copolymer, relative to the dry weight of the raw cellulose fibers, in combination with a cationic polymeric retention aid selected from the group consisting of polymeric or copolymeric polysalts based on diallyldimethylammonium chloride, the weight of the cationic polymeric retention aid to the cationic dispersion copolymer being 0.3:1 to 0.005:1, with the proviso that either the polymeric retention aid is added first and the cationic plastics dispersion is metered in afterwards or the two agents are metered separately at the same time into the aqueous cellulose fiber suspension with intensive mixing, optionally with inert fillers, pigments, dyes and conventional auxiliaries, and then isolating the acid-free base paper from the aqueous suspension in the form of base paper webs or base paper board, and drying it.

2. The process as claimed in claim 1, wherein 0.05 to 0.2% by weight, relative to the raw cellulose dry weight, of cationic polymeric retention aid is used.

3. The process as claimed in claim 1, wherein 60 to 90% of the cationic charge is located on the surface of the dispersion copolymer particles.

4. The process as claimed in claim 1, wherein 0.5 to 1% by weight of cationic dispersion copolymer, relative to the dry weight of the raw cellulose stuff, is used, the polymeric retention aid and the cationic dispersion copolymer, each relative to the polymer content thereof, being employed in a weight ratio from 0.2:1 to 0.01:1.

5. A base paper stuff produced by the process of claim 1.

* * * * *